US006899344B1

(12) United States Patent
Raynor

(10) Patent No.: US 6,899,344 B1
(45) Date of Patent: May 31, 2005

(54) MULTIDIRECTIONAL ROLLER SKATE DEVICE AND METHOD OF USING

(76) Inventor: Maurice W. Raynor, 6418-1/2 Brynhurst Ave., Los Angeles, CA (US) 90043

( * ) Notice: Subject to any disclaimer, the term of this patent is extended or adjusted under 35 U.S.C. 154(b) by 152 days.

(21) Appl. No.: 10/441,302

(22) Filed: May 15, 2003

(51) Int. Cl.[7] ..... A63C 17/00
(52) U.S. Cl. ..... 280/11.221; 280/11.226; 16/35 D
(58) Field of Search ..... 280/11.221, 11.223, 280/11.226, 11.227, 11.27, 87.01, 87.021, 280/87.041; 16/21, 22, 23, 24, 25, 26, 27, 16/28, 29, 35 D, 43, 48

(56) References Cited

U.S. PATENT DOCUMENTS

| | | | | | |
|---|---|---|---|---|---|
| 581,216 | A | * | 4/1897 | Merl | 16/21 |
| 1,428,210 | A | * | 9/1922 | Boche | 280/11.223 |
| 1,546,186 | A | * | 7/1925 | Aubitz | 16/43 |
| 1,811,532 | A | * | 6/1931 | Benetatos | 280/84 |
| 2,482,961 | A | * | 9/1949 | Bishop | 16/35 D |
| 3,466,697 | A | * | 9/1969 | Goodrich et al. | 16/26 |
| 4,076,263 | A | * | 2/1978 | Rand | 280/843 |
| 4,399,587 | A | * | 8/1983 | Penifaure | 16/35 D |
| 4,572,529 | A | * | 2/1986 | Thomas | 280/843 |
| 5,347,681 | A | * | 9/1994 | Wattron et al. | 16/30 |
| D357,523 | S | * | 4/1995 | Givens | D21/765 |
| 5,409,265 | A | * | 4/1995 | Douglass | 280/843 |
| 5,421,596 | A | * | 6/1995 | Lee | 280/11.19 |
| 5,573,309 | A | * | 11/1996 | Bekessy | 301/5.303 |
| 5,590,890 | A | * | 1/1997 | Rosso et al. | 280/11.226 |
| 5,730,467 | A | * | 3/1998 | Huang | 280/843 |
| 5,791,665 | A | * | 8/1998 | Mayer, II | 280/11.226 |
| 6,065,762 | A | * | 5/2000 | Brelvi | 280/11.226 |
| 6,134,748 | A | * | 10/2000 | Kuo | 16/35 R |
| 6,213,479 | B1 | * | 4/2001 | Cochimin | 280/7.1 |
| 6,293,565 | B1 | * | 9/2001 | Bouchard et al. | 280/11.226 |
| 6,439,584 | B1 | * | 8/2002 | Lai | 280/11.27 |
| 6,491,308 | B1 | * | 12/2002 | Bakx | 280/11.226 |

* cited by examiner

*Primary Examiner*—Christopher P. Ellis
*Assistant Examiner*—Christopher Bottorff

(57) ABSTRACT

A multidirectional roller skate device and an associated method of using the device is disclosed. The device includes a foot platform having a plurality of rolling units attached to the bottom of the foot platform. The foot platform may be either a boot for use as a roller skate or a board for use as a skate board. Each rolling unit includes a wheel, an axle, a fork, and a steering housing. The fork has a top ring; two opposing arms attached to the top ring of the fork; a first flange attached to the top ring of the fork; and a second flange attached to the top ring of the fork The steering housing has: a top plate attached to the foot platform and pivotally attached to the fork; an anchor shaft attached to the top plate; a first coil spring having a first and a second end, the first end of the first coil spring is attached to the first flange of the fork, the second end of the first coil is attached to the anchor shaft of the steering housing; a second coil spring having a first and second end, the first end of the second coil spring is attached to the second flange of the fork, the second end of the second coil is attached to the anchor shaft of the steering housing; and a rectangular bearing set attached to the steering housing and attached to the fork. The method of using the device includes the steps of balancing, bending, contacting, lifting, obtaining, placing, pushing, repeating, and standing.

9 Claims, 5 Drawing Sheets

MULTIDIRECTIONAL ROLLER SKATE DEVICE AND METHOD OF USING

FIELD OF THE INVENTION

The present invention relates to roller skate devices more, particularly to a multidirectional roller skate device for use in connection with allowing a user to glide along in multiple directions on a relatively flat hard surface, such as a sidewalk.

DESCRIPTION OF THE PRIOR ART

Skate devices have enjoyed an consistent popularity because these devices provide a pleasurable experience as well as provide an excellent form of aerobic exercise. Roller skate devices appear to have evolved from ice staking devices so that the user could enjoy the skating experience in more temperate climates. Roller skates have evolved themselves in a variety of ways by providing a number of innovations, such as in-line alignment of the wheels, spherical wheels, etc.

A wide variety of roller skate devices is currently available on the commercial market and an even larger number of these types of devices are known in the art of roller skate devices, for example, the skate disclosed by Benetatos in U.S. Pat. No. 1,811,532; the ball skate disclosed by Rand in U.S. Pat. No. 4,076,263; the roller skate disclosed by Thomas in U.S. Pat. No. 4,572,529; the skateboard with ball rollers disclosed by Douglass in U.S. Pat. No. 5,409,265; the multidirectional in-line roller skate disclosed by Brelvi in U.S. Pat. No. 6,065,762; and the skateboard disclosed by Givens in U.S. Pat. No. D357,523.

While all of the above-described devices fulfill their respective, particular objectives and requirements, the aforementioned patents do not describe a multidirectional roller skate device having a fork with a top ring; two opposing arms attached to the top ring of the fork; a first flange attached to the top ring of the fork; and a second flange attached to the top ring of the fork and a steering housing having: a top plate pivotally attached to the fork; an anchor shaft attached to the top plate; a first coil spring having a first and a second end, in which the first end of the first coil spring is attached to the first flange of the fork, the second end of the first coil is attached to the anchor shaft of the steering housing; a second coil spring having a first and second end, in which the first end of the second coil spring is attached to the second flange of the fork, the second end of the second coil is attached to the anchor shaft of the steering housing; and a rectangular bearing set attached to the steering housing and attached to the fork. This combination of elements would specifically match the user's particular individual needs of making it possible to as a means of achieving the steps of balancing, bending, contacting, lifting, obtaining, placing, pushing, repeating, and standing. The above-described patents make no provision for a multidirectional roller skate device having a fork with a top ring; two opposing arms attached to the top ring of the fork; a first flange attached to the top ring of the fork; and a second flange attached to the top ring of the fork and a steering housing having: a top plate pivotally attached to the fork; an anchor shaft attached to the top plate; a first coil spring having a first and a second end, in which the first end of the first coil spring is attached to the first flange of the fork, the second end of the first coil is attached to the anchor shaft of the steering housing; a second coil spring having a first and second end, in which the first end of the second coil spring is attached to the second flange of the fork, the second end of the second coil is attached to the anchor shaft of the steering housing; and a rectangular bearing set attached to the steering housing and attached to the fork.

Therefore, a need exists for a new and improved multidirectional roller skate device having a fork with a top ring; two opposing arms attached to the top ring of the fork; a first flange attached to the top ring of the fork; and a second flange attached to the top ring of the fork and a steering housing having: a top plate pivotally attached to the fork; an anchor shaft attached to the top plate; a first coil spring having a first and a second end, in which the first end of the first coil spring is attached to the first flange of the fork, the second end of the first coil is attached to the anchor shaft of the steering housing; a second coil spring having a first and second end, in which the first end of the second coil spring is attached to the second flange of the fork, the second end of the second coil is attached to the anchor shaft of the steering housing; and a rectangular bearing set attached to the steering housing and attached to the fork. In this respect, the multidirectional roller skate device according to the present invention substantially departs from the conventional concepts and designs of the prior art, and in doing so provides an apparatus primarily developed for the purpose of providing a means for performing the steps of balancing, bending, contacting, lifting, obtaining, placing, pushing, repeating, and standing.

SUMMARY OF THE INVENTION

The present device and method of using, according to the principles of the present invention, overcomes the shortcomings of the prior art by disclosing a unique multidirectional roller skate and an unique method of using the device. The comprises a foot platform having a plurality of rolling units attached to the bottom of the foot platform. The foot platform may be either a boot for a roller skate or a board for a skate board. Each rolling unit includes a wheel, an axle, a fork, and a steering housing. The fork has a top ring; two opposing arms attached to the top ring of the fork; a first flange attached to the top ring of the fork; and a second flange attached to the top ring of the fork. The steering housing has: a top plate attached to the foot platform and pivotally attached to the fork; an anchor shaft attached to the top plate, the anchor shaft defining a turning axis of the wheel; a first coil spring having a first and a second end, the first end of the first coil spring is attached to the first flange of the fork, the second end of the first coil is attached to the anchor shaft of the steering housing; a second coil spring having a first and second end, the first end of the second coil spring is attached to the second flange of the fork, the second end of the second coil is attached to the anchor shaft of the steering housing; and a rectangular bearing set attached to the steering housing and attached to the fork. The method of using the device comprises balancing, bending, contacting, lifting, obtaining, placing, pushing, repeating, standing.

In view of the foregoing disadvantages inherent in the known type skate devices now present in the prior art, the present invention provides an improved multidirectional roller skate device, which will be described subsequently in great detail, is to provide a new and improved multidirectional roller skate device which is not anticipated, rendered obvious, suggested, or even implied by the prior art, either alone or in any combination thereof.

To attain this, the present invention essentially comprises a foot platform having a plurality of rolling units attached to the bottom of the foot platform. The foot platform may be either a boot for a roller skate or a board for a skate board. Each rolling unit includes a wheel, an axle, a fork, and a steering housing. The fork has a top ring; two opposing arms attached to the top ring of the fork; a first flange attached to the top ring of the fork; and a second flange attached to the lop ring of the fork. The steering housing has: a top plate attached to the foot platform and pivotally attached to the fork; an anchor shaft attached to the top plate, the anchor shaft defining a turning axis of the wheel; a first coil spring having a first and a second end, the first end of the first coil spring is attached to the first flange of the fork, the second end of the first coil is attached to the anchor shaft of the steering housing; a second coil spring having a first and second end, the first end of the second coil spring is attached to the second flange of the fork, the second end of the second coil is attached to the anchor shaft of the steering housing; and a rectangular bearing set attached to the steering housing and attached to the fork.

There has thus been outlined, rather broadly, the more important features of the invention in order that the detailed description thereof that follows may be better understood, and in order that the present contribution of the art may be better appreciated.

The invention may also include an optional ball bearing set. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multidirectional roller skate device that has all the advantages of the prior art multidirectional roller skate device and none of the disadvantages.

It is another object of the present invention to provide a new and improved multidirectional roller skate device that may be easily and efficiently manufactured and marketed.

An even further object of the present invention is to provide a new and improved multidirectional roller skate device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new multidirectional roller skate device that provides in the apparatuses and methods of the prior art some of the advantages thererof, while simultaneously overcoming some of the disadvantages normally associated therewith.

Even still another object of the present invention is to provide a multidirectional roller skate device having a fork with a top ring; two opposing arms attached to the top ring of the fork; a first flange attached to the top ring of the fork; and a second flange attached to the top ring of the fork and a steering housing having: a top plate pivotally attached to the fork; an anchor shaft attached to the top plate; a first coil spring having a first and a second end, in which the first end of the first coil spring is attached to the first flange of the fork, the second end of the first coil is attached to the anchor shaft of the steering housing; a second coil spring having a first and second end, in which the first end of the second coil spring is attached to the second flange of the fork, the second end of the second coil is attached to the anchor shaft of the steering housing; and a rectangular bearing set attached to the steering housing and attached to the fork. This combination of elements makes it possible to use the device in the steps of balancing, bending, contacting, lifting, obtaining, placing, pushing, repeating, and standing.

Lastly, it is an object of the present invention to provide a new and improved method of using comprising the steps of balancing, bending, contacting, lifting, obtaining, placing, pushing, repeating, and standing.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
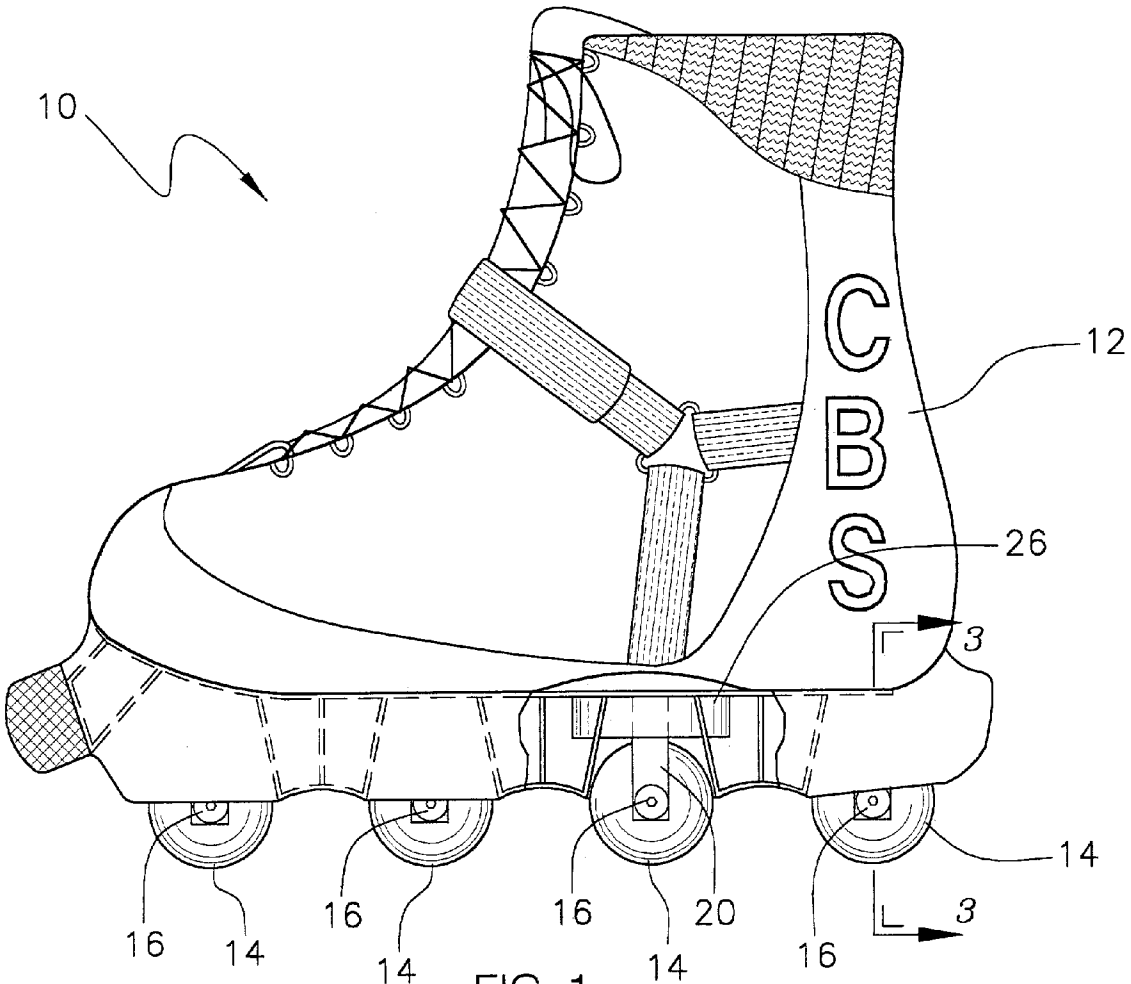
FIG. 1 is a perspective view of a preferred embodiment of the multidirectional roller skate device constructed in accordance with the principles of the present invention.
Figure 3:
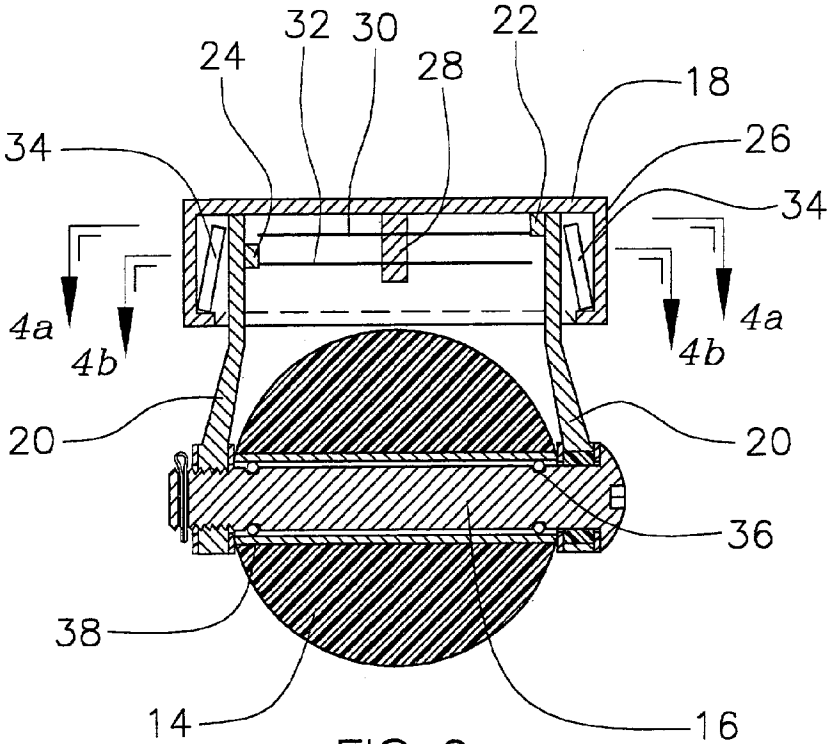
FIG. 3 is a cross sectional side view of a preferred embodiment of the rolling unit multidirectional roller skate device of the present invention.
Figure 2:
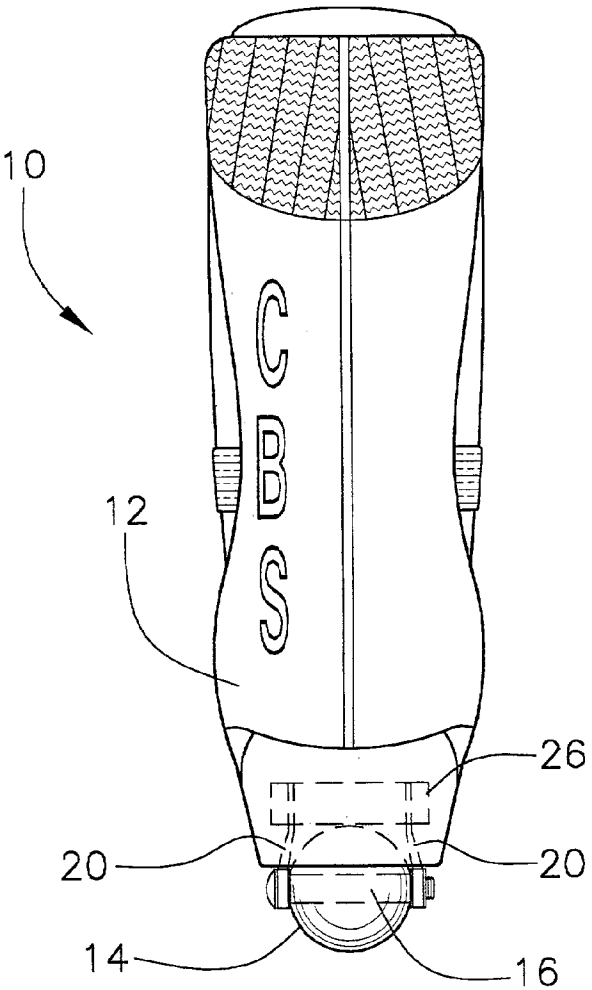
FIG. 2 is a rear view of a preferred embodiment of the multidirectional roller skate device of the present invention.
Figures 4A, 4B:
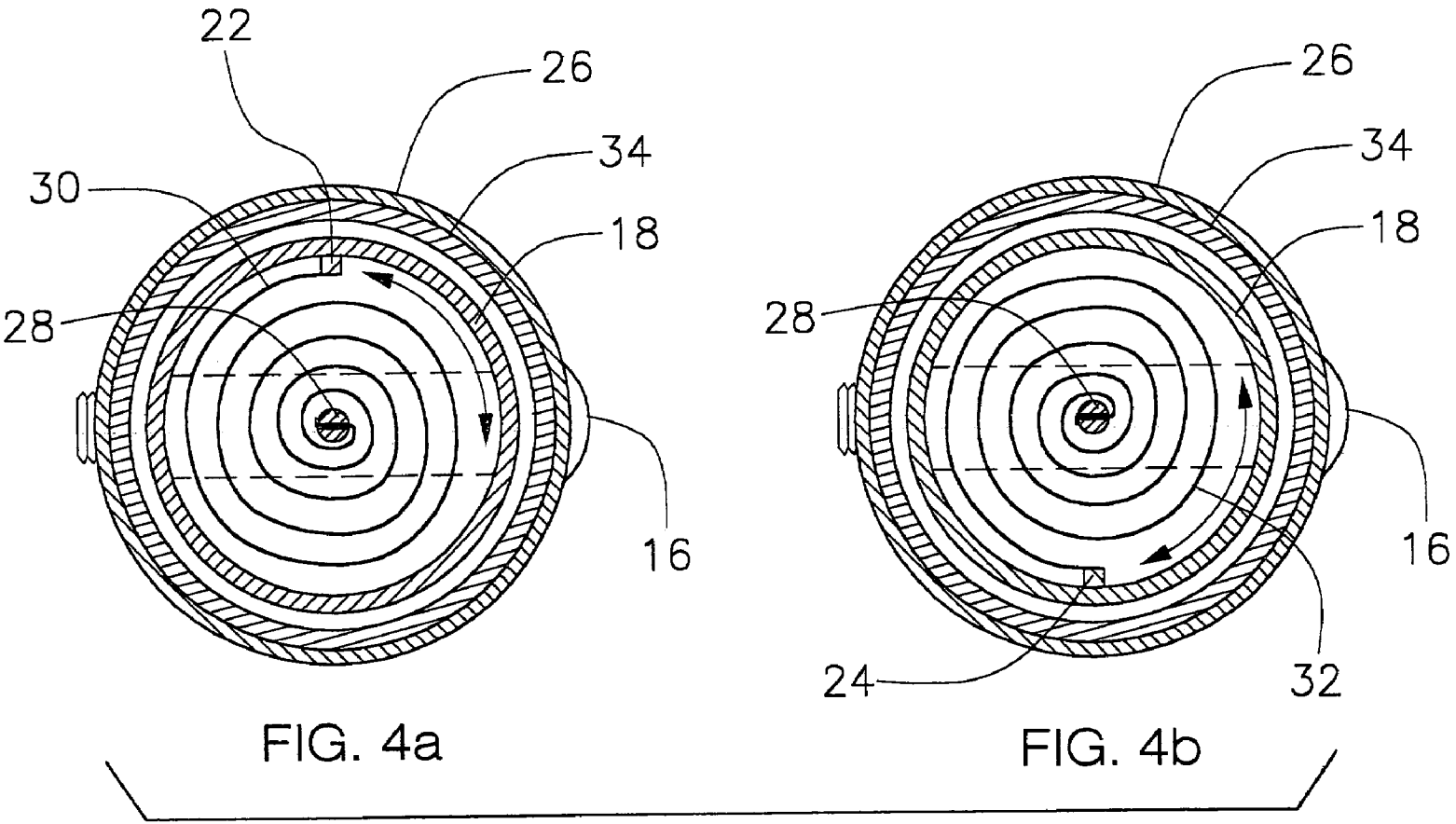
FIGS. 4*a* and 4*b* is a cross sectional top view of a preferred embodiment of the rolling unit of the multidirectional roller skate device of the present invention.
Figures 5, 6:
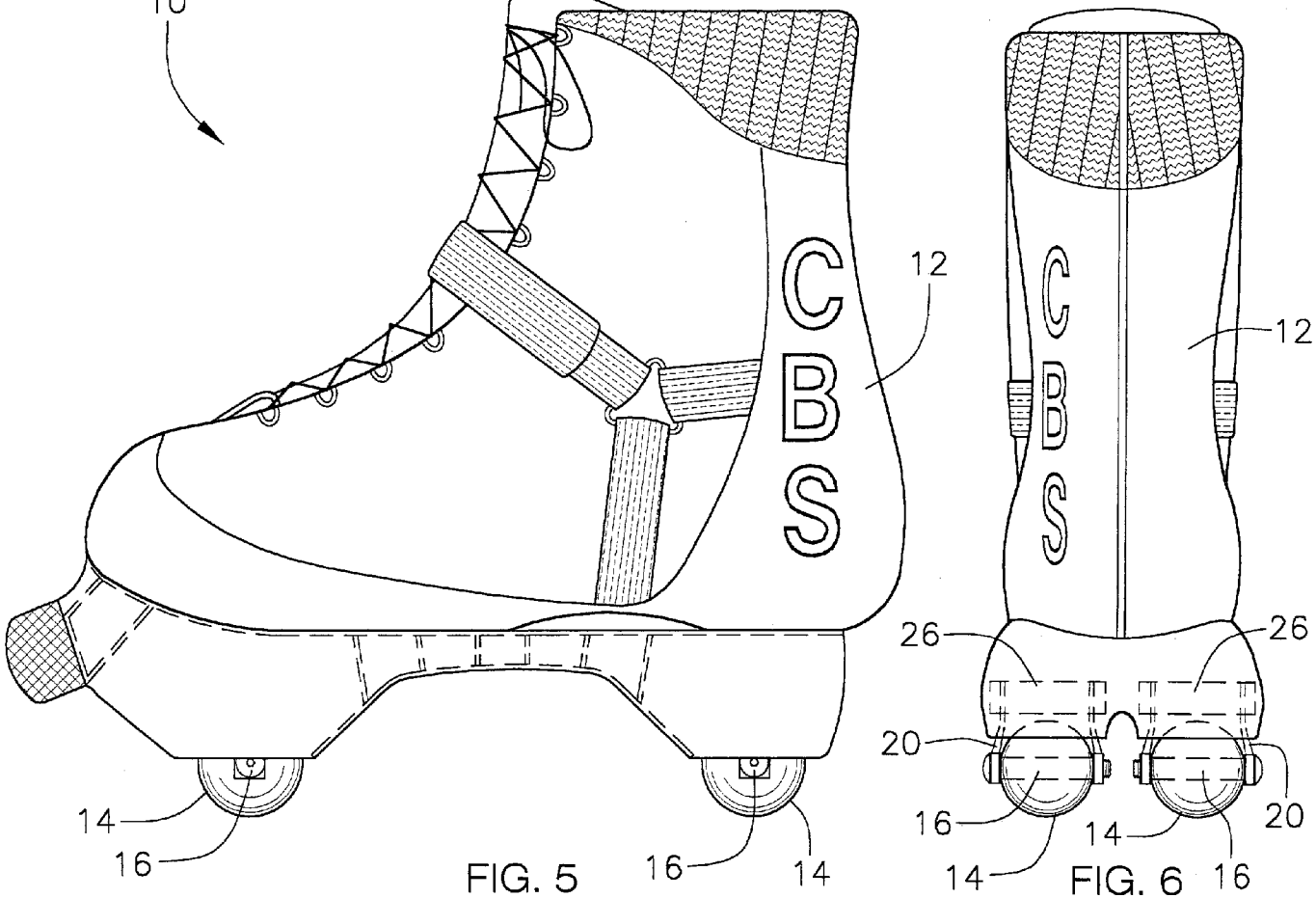
FIG. 5 is a side view of a preferred embodiment of the multidirectional roller skate device constructed in accordance with the principles of the present invention.
FIG. 6 is a rear view of a preferred embodiment of the multidirectional roller skate device of the present invention.
Figure 7:
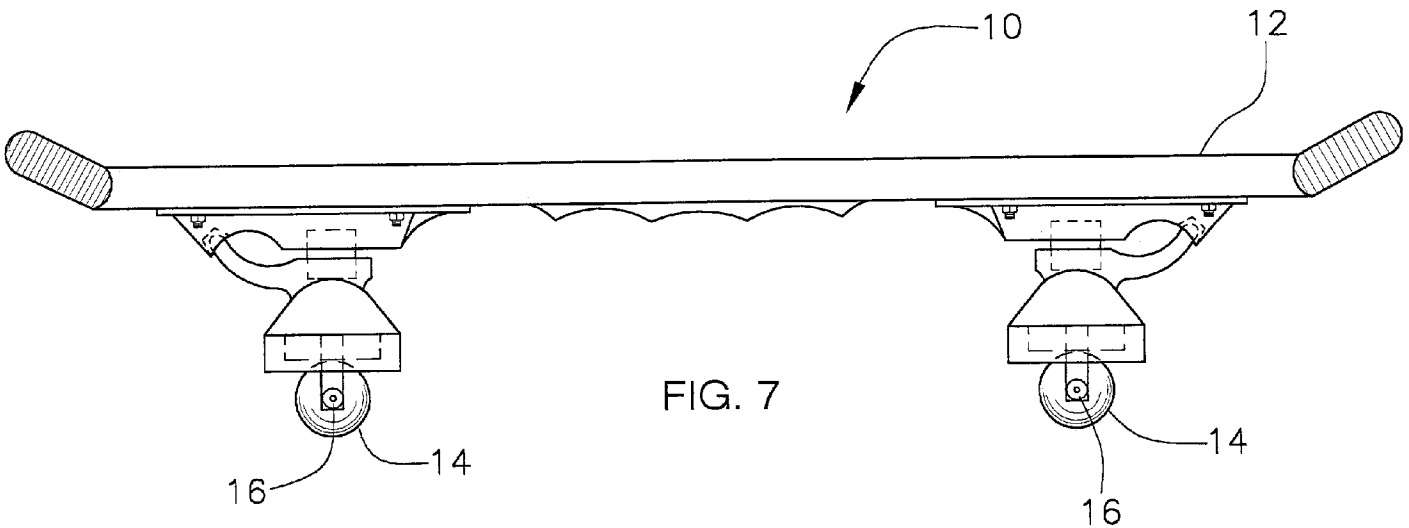
FIG. 7 is a side view of a preferred embodiment of the multidirectional roller skate device of the present invention.
Figure 8:
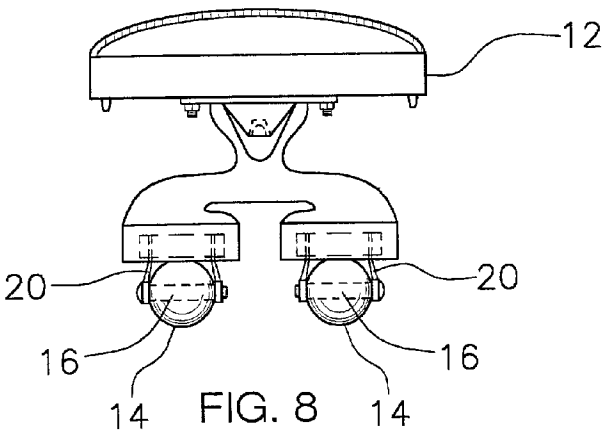
FIG. 8 is a rear view of a preferred embodiment of the multidirectional roller skate device of the present invention.

Referring now to the drawings, and in particular FIG. 1 to 8 thereof, one preferred embodiment of the present invention is shown and generally designated by the reference numeral 10. One preferred embodiment of a multidirectional roller skate device 10 comprising: a foot platform 12; and a plurality of rolling units attached to the foot platform 12, each rolling unit including: a wheel 14 having an orifice traversing through the wheel 14; an axle 16 attached to the wheel 14, the axle 16 is mounted within the orifice of the wheel 14 and having two opposing ends extending outwardly beyond the wheel 14; a fork having: a top ring 18; two opposing arms 20 attached to the top ring 18 of the fork; a first flange 22 attached to the top ring 18 of the fork; and a second flange 24 attached to the top ring 18 of the fork; and a steering housing having: a top plate 26 attached to the foot platform 12 and pivotally attached to the fork; an anchor shaft 28 attached to the top plate 26, the anchor shaft 28 defining a turning axis of the wheel 14; a first coil spring 30 having a first and a second end, the first end of the first coil spring 30 is attached to the first flange 22 of the fork, the second end of the first coil is attached to the anchor shaft 28 of the steering housing; a second coil spring 32 having a first and second end, the first end of the second coil spring 32 is attached to the second flange 24 of the fork, the second end of the second coil is attached to the anchor shaft 28 of the steering housing; and a rectangular bearing set 34 attached to the steering housing and attached to the fork.

An optional second foot platform 12; and a second plurality of rolling units attached to the second foot platform 12 may be added to the device 10 making up a pair of roller skates.

An optional pair of ball bearing sets 36 may be added to the device 10 wherein the pair of ball bearing sets are attached to the axle 16 in a pair of slots 38 in the axle 16.

The wheels 14 of the device 10 may comprise any known wheel shape. One most preferred configuration is that the wheel 14 has a substantially spherical shape.

The foot platform 12 may be a boot having a shoe lace and a brake pad or a board, in other words the device may either be a roller skate or a skate board.

Another preferred embodiment of a multidirectional roller skate device 10 consisting essentially of: a foot platform 12; and a plurality of rolling units attached to the foot platform 12, each rolling unit including: a wheel 14 having an orifice traversing through the wheel 14; an axle 16 attached to the wheel 14, the axle 16 is mounted within the orifice of the wheel 14 and having two opposing ends extending outwardly beyond the wheel 14; a fork having: a top ring 18; two opposing arms 20 attached to the top ring 18 of the fork; a first flange 22 attached to the top ring 18 of the fork; and a second flange 24 attached to the top ring 18 of the fork; and a steering housing having: a top plate 26 attached to the foot platform 12 and pivotally attached to the fork; an anchor shaft 28 attached to the top plate 26, the anchor shaft 28 defining a turning axis of the wheel 14; a first coil spring 30 having a first and a second end, the first end of the first coil spring 30 is attached to the first flange 22 of the fork, the second end of the first coil is attached to the anchor shaft 28 of the steering housing; a second coil spring 32 having a first and second end, the first end of the second coil spring 32 is attached to the second flange 24 of the fork, the second end of the second coil is attached to the anchor shaft 28 of the steering housing; and a rectangular bearing set 34 attached to the steering housing and attached to the fork.

One preferred embodiment of a method of using a multidirectional roller skate device 10, the method comprising the steps of: balancing, bending, contacting, lifting, obtaining, placing, pushing, repeating, and standing. The obtaining step comprises obtaining the device comprising: a foot platform 12; and a plurality of rolling units attached to the foot platform 12, each rolling unit including: a wheel 14 having an orifice traversing through the wheel 14; an axle 16 attached to the wheel 14, the axle 16 is mounted within the orifice of the wheel 14 and having two opposing ends extending outwardly beyond the wheel 14; a fork having: a top ring 18; two opposing arms 20 attached to the top ring 18 of the fork; a first flange 22 attached to the top ring 18 of the fork; and a second flange 24 attached to the top ring 18 of the fork; and a steering housing having: a top plate 26 attached to the foot platform 12 and pivotally attached to the fork; an anchor shaft 28 attached to the top plate 26, the anchor shaft 28 defining a turning axis of the wheel 14; a first coil spring 30 having a first and a second end, the first end of the first coil spring 30 is attached to the first flange 22 of the fork, the second end of the first coil is attached to the anchor shaft 28 of the steering housing; a second coil spring 32 having a first and second end, the first end of the second coil spring 32 is attached to the second flange 24 of the fork, the second end of the second coil is attached to the anchor shaft 28 of the steering housing; and a rectangular bearing set 34 attached to the steering housing and attached to the fork. The contacting step comprises contacting the wheels 14 of the device 10 onto a substantially flat hardened surface. The standing step comprises standing on the foot platform 12 of the device 10 with a left foot of a user, the standing step performed subsequent to the contacting step. The bending step comprises bending forward a portion of an upper torso of the user while standing on the foot platform 12 of the device 10. The pushing step comprises pushing onto the hardened surface with a right foot of the user's right leg in a backwards direction relative to the user to propel the device 10 in a forward direction relative to the user. The lifting step comprises lifting up the right foot from the hardened surface subsequent to the pushing step. The placing step comprises placing the right foot onto the foot platform 12 of the device 10 subsequent to the lifting step. The balancing step comprises balancing by the user onto the foot platform 12 of the device 10 while the device 10 is propelled in the forward direction. The repeating step comprises repeating sequentially the bending, pushing, lifting, placing, and balancing steps.

Another preferred embodiment of a method of using a multidirectional roller skate device 10, the method consists essentially of the steps of: balancing, bending, contacting, lifting, obtaining, placing, pushing, repeating, and standing.

As to the manner of usage and operation of the present invention, the same should be apparent from the above description. Accordingly, no further discussion relating to the manner of usage and operation will be provided.

While a preferred embodiment of the multidirectional roller skate device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of the steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multidirectional roller skate device comprising:
- a foot platform; and
- a plurality of rolling units attached to said foot platform, each rolling unit including:
  - a wheel having an orifice traversing through said wheel;
  - an axle attached to said wheel, said axle is mounted within the orifice of said wheel and having two opposing ends extending outwardly beyond said wheel;
  - a fork having:
    - a top ring;
    - two opposing arms attached to said top ring of said fork;
    - a first flange attached to said top ring of said fork; and
    - a second flange attached to said top ring of said fork; and
  - a steering housing having:
    - a top plate attached to said foot platform and pivotally attached to said fork;
    - an anchor shaft attached to said top plate, said anchor shaft defining a turning axis of said wheel;
    - a first coil spring having a first and a second end, the first end of said first coil spring is attached to said first flange of said fork, the second end of said first coil is attached to said anchor shaft of said steering housing;
    - a second coil spring having a first and second end, the first end of said second coil spring is attached to said second flange of said fork, the second end of said second coil is attached to said anchor shaft of said steering housing; and
    - a rectangular bearing set attached to said steering housing and attached to said fork.

2. The device of claim 1 further comprising:
- a second foot platform; and
- a second plurality of rolling units attached to said second foot platform.

3. The device of claim 1 further comprising a pair of ball bearing sets attached to said axle in a pair of slots in said axle.

4. The device of claim 1 wherein said wheel having a non-spherical shape.

5. The device of claim 1 wherein said wheel having a substantially spherical shape.

6. The device of claim 1 wherein said foot platform is a boot having a shoe lace and a brake pad.

7. The device of claim 1 wherein said foot platform is a board, wherein said device is a skateboard.

8. A multidirectional roller skate device consisting essentially of:
- a foot platform; and
- a plurality of rolling units attached to said foot platform, each rolling unit including:
  - a wheel having an orifice traversing through said wheel;
  - an axle attached to said wheel, said axle is mounted within the orifice of said wheel and having two opposing ends extending outwardly beyond said wheel;
  - a fork having:
    - a top ring;
    - two opposing arms attached to said top ring of said fork;
    - a first flange attached to said top ring of said fork; and
    - a second flange attached to said top ring of said fork; and
  - a steering housing having:
    - a top plate attached to said foot platform and pivotally attached to said fork;
    - an anchor shaft attached to said top plate, said anchor shaft defining a turning axis of said wheel;
    - a first coil spring having a first and a second end, the first end of said first coil spring is attached to said first flange of said fork, the second end of said first coil is attached to said anchor shaft of said steering housing;
    - a second coil spring having a first and second end, the first end of said second coil spring is attached to said second flange of said fork, the second end of said second coil is attached to said anchor shaft of said steering housing; and
    - a rectangular bearing set attached to said steering housing and attached to said fork.

9. A method of using a multidirectional roller skate device, said method comprising the steps of: obtaining the device comprising:
- a foot platform; and
- a plurality of rolling units attached to said foot platform, each rolling unit including:

a wheel having an orifice traversing through said wheel;

an axle attached to said wheel, said axle is mounted within the orifice of said wheel and having two opposing ends extending outwardly beyond said wheel;

a fork having:

a top ring;

two opposing arms attached to said top ring of said fork;

a first flange attached to said top ring of said fork; and a second flange attached to said top ring of said fork; and a steering housing having:

a top plate attached to said foot platform and pivotally attached to said fork;

an anchor shaft attached to said top plate, said anchor shaft defining a turning axis of said wheel;

a first coil spring having a first and a second end, the first end of said first coil spring is attached to said first flange of said fork, the second end of said first coil is attached to said anchor shaft of said steering housing;

a second coil spring having a first and second end, the first end of said second coil spring is attached to said second flange of said fork, the second end of said second coil is attached to said anchor shaft of said steering housing; and a rectangular bearing set attached to said steering housing and attached to said fork;

contacting the wheels of the device onto a substantially flat hardened surface;

standing on the foot platform of the device with a left foot of a user, said standing step performed subsequent to said contacting step;

bending forward a portion of an upper torso of the user while standing on the foot platform of the device;

pushing onto the hardened surface with a right foot of the user's right leg in a backwards direction relative to the user to propel the device in a forward direction relative to the user;

lifting up the right foot from the hardened surface subsequent to said pushing step;

placing the right foot onto the foot platform of the device subsequent to said lifting step;

balancing by the user onto the foot platform of the device while the device is propelled in the forward direction; and repeating sequentially said bending, pushing, lifting, placing, and balancing steps.

* * * * *